US005506366A

United States Patent [19]

Barnard et al.

[11] Patent Number: 5,506,366

[45] Date of Patent: Apr. 9, 1996

[54] DESENSITIZATION OF CURED ENERGETIC COMPOSITIONS IN AQUEOUS MEDIA

[75] Inventors: James C. Barnard, Shingle Springs; Donald M. Kunkle, Folsom; Bennie L. Benning, Cameron Park; Ernest W. Leachty, Diamond Springs; Renato R. Rindone, Fair Oaks, all of Calif.

[73] Assignee: Aerojet General Corporation, Rancho Cordova, Calif.

[21] Appl. No.: 218,328

[22] Filed: Mar. 25, 1994

[51] Int. Cl.$^6$ ..... C06B 21/00

[52] U.S. Cl. ..... 588/203; 588/202; 149/124

[58] Field of Search ..... 149/124; 588/202, 588/203

[56] References Cited

U.S. PATENT DOCUMENTS

| | | | |
|---|---|---|---|
| 3,451,789 | 6/1969 | McIntosh | 23/302 R |
| 3,586,551 | 6/1971 | Nolan | 149/2 |
| 4,231,822 | 11/1980 | Roth | 149/109.6 |
| 4,430,132 | 2/1984 | Painter | 149/109.6 |
| 4,758,387 | 7/1988 | Sayles | 264/3.1 |
| 5,133,877 | 7/1992 | Rofer et al. | 210/761 |
| 5,211,777 | 5/1993 | Nahlovsky et al. | 149/109.6 |
| 5,238,512 | 8/1993 | Persson | 149/19.2 |

*Primary Examiner*—Ngoclan Mai

*Attorney, Agent, or Firm*—Townsend and Townsend and Crew

[57] ABSTRACT

Solid energetic compositions such as rocket motor grains are desensitized and converted to a form suitable for incineration by size reducing the solids, combining them with water to form a slurry, and adding shredded paper or similar cellulosic material in an amount sufficient to absorb most if not all of the water. The result is a composition which is non-detonable, and yet capable of incineration in a clean manner to produce useful by-products.

10 Claims, No Drawings

DESENSITIZATION OF CURED ENERGETIC COMPOSITIONS IN AQUEOUS MEDIA

This invention lies in the field of solid rocket propellants and related compositions, and relates to methods for the disposal of waste compositions of this nature.

BACKGROUND OF THE INVENTION

Energetic compositions such as those used as explosives and propellants present a well-recognized problem when it becomes necessary to dispose of such materials as waste. Waste occurs for example as the result of the regraining of rocket motors, and in similar situations with similar materials for a variety of reasons. Early methods of disposal of these compositions involved deep water or ocean dumping, which is now prohibited by law. One method in current use is open-pit burning, although a continuing concern with open-pit burning is the risk of ground water and air pollution. As a result, each use of this method requires a special exemption from regulatory authorities. The alternative of incinerator burning offers certain advantages, but the scrubbers used to control emissions from incinerators produce liquid waste which has its own disposal problems. A variety of other alternatives have been investigated, including such methods as binder solvolysis, wet air oxidation, supercritical fluid extraction and/or oxidation, electrolysis and biodegradation.

Controlled burning in a closed system is potentially both cost-effective and environmentally safe. Castable and extrudable compositions for this purpose have been disclosed, as for example in U.S. Pat. No. 5,211,777, issued May 18, 1993, which compositions include oils as suspending media. The present invention avoids the use of oils and thereby provides a further advantage in handling and burning, as well as in the cost of materials.

SUMMARY OF THE INVENTION

Solid energetic compositions, in accordance with this invention, are reduced to particulate form and combined with water in an aqueous slurry. Water-absorptive cellulosic material such as paper or cotton is then added to the slurry to absorb much if not all of the water, thereby achieving a highly viscous mass of a consistency which can be shaped, extruded, and in certain embodiments, pumped. The result is a material which is no longer susceptible to detonation and can be incinerated as a non-explosive without being contaminated by organic materials. For energetic compositions which contain aluminum as a fuel, the combustion product is a highly pure aluminum oxide. The invention is of particular interest when applied to cured propellants, and it avoids the need for inorganic desentizing agents such as calcium hydroxide, sodium hydroxide, potassium hydroxide and ammonium hydroxide.

These and other features, applications and advantages of the invention will become apparent from the description which follows.

DETAILED DESCRIPTION OF THE INVENTION AND PREFERRED EMBODIMENTS

While the invention is applicable to a wide range of energetic compositions, the formation of an aqueous slurry in accordance with this invention is particularly convenient for those embodiments in which the energetic composition is solid rocket propellant grain. Water is frequently used as a high pressure jet to remove the composition from a rocket motor. The application of high-pressure water to the rocket motor in this manner is known in the industry as the hydromining or "hog-out" of the propellant. This process produces chunks of the propellant grain in a body of water.

In the optimum practice of the present invention, the solid particles are chopped, shredded, ground, or otherwise reduced to a small particle size. In the case of rocket motor propellant grains, this may be achieved by maceration of the material in the water, using conventional industrial macerators or blenders. Best results are obtained when the particles are below a critical diameter, which is defined as the diameter below which the material can no longer be detonated as individual particles. The critical diameter will vary among different energetic compositions, but will generally be less than about one inch in diameter, preferably less than about one-quarter inch, and generally from about one-eighth inch to about one-quarter inch.

The amount of water present also contributes to the suppression of detonability. In general, however, the amount is not critical and can vary. Best results are generally achieved with procedures in which the water constitutes at least about 40% by weight of the slurry of water and energetic material solids, preferably from about 45% to about 85%, and most preferably from about 55% to about 75%. In the presently preferred practice of this invention, the slurry contains approximately 66% water by weight.

The cellulosic material may be any of the wide variety of water-absorptive forms of cellulose, provided that it is flammable but not itself an energetic material. Examples are paper and paper products, and cotton and cotton products. Paper and paper products are particularly preferred. Shredded paper, such as that used as attic insulation material, is particularly useful. The form of the paper is not critical, and may vary. Strips of paper less than about 0.25 inch in width may be used, for example. In the presently preferred practice of the invention, paper strips of 0.125 inch in width are used.

The amount of paper or other cellulosic material may vary, depending on the absorbancy of the material, the amount of water present in the slurry, and the desired consistency of the final product. In preferred embodiments of the invention, the cellulosic material content ranges from about 3% to about 30% by weight relative to the water in the slurry (i.e., 3% to 30% of the total of cellulosic material and water), preferably from about 5% to about 10% relative to the water.

The cellulosic material may be combined with the slurry in any conventional manner, using conventional equipment. For shredded paper, a ribbon blender may be used effectively.

Additional components may be included in the final composition, although in most cases, compositions of the desired properties may be achieved with only the combination of the energetic composition, water and the cellulosic material. When additives are included, they may be binders, thickening agents, anti-sticking agents and desensitizing agents. Examples of binders are waxes; examples of thickening agents are glycerides, carboxymethylcellulose salts, and thixotropic agents in general; examples of anti-sticking agents are powders; and examples of desensitizing agents are oxalic acid and oxalic acid salts such as ammonium oxalate. These additives may be used alone or in combination, in appropriate proportions and amounts which will be readily apparent to those routinely skilled in the use of these materials. A particularly preferred additive is sodium carboxymethylcellulose, included as a thickener. A preferred amount is about 0.2% to about 0.5% by weight relative to the water present in the composition.

The following example is offered for illustrative purposes only.

EXAMPLE

A total of 4200 pounds of cured SICBM Stage II propellant, a typical rocket motor propellant, was desensitized in 140-pound batches in accordance with the invention. The solid propellant was combined with water at a water-to-propellant weight ratio of 2:1 and macerated to reduce the propellant particle diameter to within 0.125 to 0.25 inch to produce a slurry. After maceration, cellulose fiber insulation material (i.e., common commercially available attic insulation material) was blended into the slurry at a ratio of 4.8 pounds of cellulose per pound of slurry.

A series of standard hazard tests under protocols established by the United States Department of Transportation were then performed on one of the batches. These included the National Ordnance Laboratory Card Gap Test, the No. 8 Blasting Cap Test, the Unconfined Burn Test, and the Thermal Stability Test. The results in all tests were negative, indicating that the desensitized mixture was unreactive.

The desensitized mixture was then charged to 5-gallon polyethylene containers at 40 pounds per container. Each container was then incinerated in a full-scale two-chambered fixed hearth incinerator equipped with scrubbers. The primary chamber was operated at a mean temperature of 1875° F. and the secondary chamber at 2123° F. Feed rates of the desensitized mixture to the chambers ranged from 320 to 349 pounds per hour, and emissions were analyzed. The analyses are listed in the table below, which also lists the maximum permissible limits as set forth by the Resource Conservation and Recovery Act (RCRA). It is clear from the table that the emissions were well within the limit at each of the three flow rates tested.

TABLE

Continuous Emission Monitor Results for Trial Burn

| Feed Rate of Desensitized Propellant to Combustion Chambers (lb/h) | Emission Analyses | | |
|---|---|---|---|
| | $NO_x$ (ppm) | CO (ppm) | Total Hydrocarbons (ppm) |
| 349 | 129 | 8 | 0.1 |
| 320 | 133 | 4 | 0.1 |
| 327 | 129 | 34 | 1.0 |
| (RCRA Limit: | 250 | 100 | 20.0) |

The foregoing is offered primarily for purposes of illustration. It will be readily apparent to those skilled in the art that the operating conditions, materials, procedural steps and other parameters of the system described herein may be further modified or substituted in various ways without departing from the spirit and scope of the invention.

What is claimed is:

1. A method for desensitizing a cured solid energetic composition without the use of a hydrocabon liquid, said method comprising:

(a) combining said cured solid energetic composition in particulate form with water in an amount sufficient to render said cured solid energetic composition non-detonable and to thereby form an aqueous slurry; and (b) combining said slurry with a cellulosic material in sufficient quantity and of sufficient water absorptivity to absorb at least about 50% of the water in said slurry.

2. A method in accordance with claim 1 in which step (a) further comprises reducing said cured solid energetic composition to a particle size of less than about one-quarter inch in diameter.

3. A method in accordance with claim 1 in which said cellulosic material is a member selected from the group consisting of paper and cotton.

4. A method in accordance with claim 1 in which said cellulosic material is shredded paper.

5. A method in accordance with claim 1 in which said cellulosic material is shredded paper in the form of strips of less than about 0.25 inch in width.

6. A method in accordance with claim 1 further comprising combining said slurry with a thickening agent.

7. A method in accordance with claim 6 in which said thickening agent is a carboxymethylcellulose salt.

8. A method in accordance with claim 1 in which step (b) comprises combining said slurry with shredded paper and a carboxymethylcellulose salt.

9. A method in accordance with claim 1 in which step (a) comprises using a weight ratio of water to solid energetic composition ranging from about 45% to about 85%.

10. A method in accordance with claim 1 in which step (a) comprises using a weight ratio of water to solid energetic composition ranging from about 55% to about 75%.

* * * * *